US010527996B2

(12) United States Patent
Soda

(10) Patent No.: US 10,527,996 B2
(45) Date of Patent: Jan. 7, 2020

(54) IMAGE FORMING APPARATUS

(71) Applicant: KYOCERA Document Solutions Inc., Osaka-shi (JP)

(72) Inventor: Tomohisa Soda, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/357,374

(22) Filed: Mar. 19, 2019

(65) Prior Publication Data

US 2019/0286041 A1 Sep. 19, 2019

(30) Foreign Application Priority Data

Mar. 19, 2018 (JP) ..... 2018-050717

(51) Int. Cl.

| | |
|---|---|
| ***G03G 15/06*** | (2006.01) |
| ***G03G 15/00*** | (2006.01) |
| ***G03G 15/01*** | (2006.01) |
| ***G03G 15/08*** | (2006.01) |

(52) U.S. Cl.

CPC ..... *G03G 15/556* (2013.01); *G03G 15/0121* (2013.01); *G03G 15/0893* (2013.01)

(58) Field of Classification Search

CPC ..... G03G 15/087; G03G 15/556; G03G 15/0822; G03G 15/0862; G03G 15/0865; G03G 15/0867; G03G 15/0868; G03G 15/0872; G03G 15/0877; G03G 15/0879; G03G 2215/066; G03G 2215/0663; G03G 2215/0665; G03G 2215/0678; G03G 2215/0685

See application file for complete search history.

(56) References Cited

U.S. PATENT DOCUMENTS

| | | | | |
|---|---|---|---|---|
| 2004/0052538 | A1* | 3/2004 | Yugeta | G03G 15/0856 399/27 |
| 2016/0170356 | A1* | 6/2016 | Mabuchi | G03G 15/55 399/27 |
| 2016/0259286 | A1* | 9/2016 | Akiba | G03G 15/55 |
| 2019/0086832 | A1* | 3/2019 | Nohara | G03G 15/16 |
| 2019/0086835 | A1* | 3/2019 | Nohara | G03G 15/0868 |
| 2019/0187603 | A1* | 6/2019 | Soda | G03G 15/0867 |

FOREIGN PATENT DOCUMENTS

| | | |
|---|---|---|
| JP | 2011-197229 | 10/2011 |
| JP | 2014-157350 | 8/2014 |

* cited by examiner

*Primary Examiner* — Thomas S Giampaolo, II
(74) *Attorney, Agent, or Firm* — Gerald E. Hespos; Michael J. Porco; Matthew T. Hespos

(57) ABSTRACT

An image forming device includes: a developing device; a first toner container; a second toner container; a first vertical transport part; a second vertical transport part; a first horizontal transport part; a second horizontal transport part; a third horizontal transport part; a third vertical transport part, a counting unit; and a consumption amount calculation unit. The consumption amount calculation unit, in accordance with a rotation time accumulated by the counting unit, calculates a flow rate of toner flowing in the third horizontal transport part in each of the first supply state and the second supply state, and thereby calculates a toner consumption amount of each of the first toner container and the second toner container.

7 Claims, 8 Drawing Sheets

IMAGE FORMING APPARATUS

INCORPORATION BY REFERENCE

This application is based on Japanese Patent Application Serial No. 2018-050717 filed with the Japan Patent Office on Mar. 19, 2018, the contents of which are hereby incorporated by reference.

BACKGROUND

The present disclosure relates to an image forming device for forming an image on a sheet.

Conventionally, an image forming device such as a printer or a copier employing the electrophotographic method includes: a photoreceptor drum that carries an electrostatic latent image; a developing device that supplies toner to the photoreceptor drum and visualizes the electrostatic latent image into a toner image; and a transfer device that transfers the toner image from the photoreceptor drum onto a sheet.

Further, an image forming device is known which has a plurality of developing devices in correspondence to color toners of respective colors and in which, for each developing device, two toner containers for supplying supplement toner to the developing device are disposed. Even when one of the toner containers becomes empty, toner from the other toner container can be supplied. Hence, the time over which the image forming device is forced to stop (print incapable time) is shortened. Particularly when a print job involving a large number of sheets to be printed is executed, a situation in which the job is interrupted halfway due to toner shortage can be prevented.

Also, a technique is known of calculating a toner consumption amount of a toner container based on a rotation count of a transport screw arranged in a transport path between the toner container and a developing device.

SUMMARY

An image forming device according to one aspect of the present disclosure includes: a device main body; a photoreceptor drum; a developing device; a first toner container; a second toner container; a first vertical transport part; a second vertical transport part; a first horizontal transport part; a second horizontal transport part; a first transport member; a second transport member; a third horizontal transport part; a third transport member; a third vertical transport part; a first transport driving unit; a second transport driving unit; a container driving unit; a first detection sensor; a second detection sensor; a drive control unit; a counting unit; and a consumption amount calculation unit. The photoreceptor drum is rotated about a predetermined axis and has a circumferential surface that allows an electrostatic latent image to be formed and carries a toner image that is in accordance with the electrostatic latent image. The developing device supplies toner to the photoreceptor drum to visualize the electrostatic latent image into the toner image. The first toner container and the second toner container store toner inside and are capable of discharging the toner. The first vertical transport part guides toner discharged from the first toner container downward along a vertical direction. The second vertical transport part guides toner discharged from the second toner container downward along the vertical direction. The first horizontal transport part communicates with a lower end part of the first vertical transport part and guides toner having flowed in from the first vertical transport part in a first direction along a horizontal direction. The second horizontal transport part communicates with a lower end part of the second vertical transport part and guides toner having flowed in from the second vertical transport part in a second direction along the horizontal direction. The first transport member is rotatably arranged in the first horizontal transport part and transports toner in the first direction. The second transport member is rotatably arranged in the second horizontal transport part and transports toner in the second direction. The third horizontal transport part communicates with each of a first direction downstream portion of the first horizontal transport part and a second direction downstream portion of the second horizontal transport part, and receives toner having been transported by the first transport member and toner having been transported by the second transport member at an inside of the third horizontal transport part and guides the toner in a third direction along the horizontal direction. The third transport member is rotatably arranged in the third horizontal transport part and transports toner in the third direction. The third vertical transport part communicates with a third direction downstream portion of the third horizontal transport part and guides toner having been transported by the third transport member to the developing device along the vertical direction. The first transport driving unit generates driving force for selectively rotating the first transport member or the second transport member. The second transport driving unit generates driving force for rotating the third transport member. The container driving unit generates driving force for selectively discharging toner from the first toner container or the second toner container. The first detection sensor is arranged at the first vertical transport part and detects whether or not toner is present in the first vertical transport part. The second detection sensor is arranged at the second vertical transport part and detects whether or not toner is present in the second vertical transport part. The drive control unit controls the first transport driving unit, the second transport driving unit, and the container driving unit. The drive control unit is capable of switching between a first supply state and a second supply state, the first supply state being a state in which, in accordance with a toner supply request from the developing device, toner is supplied to the developing device from the first toner container, the first vertical transport part, the first horizontal transport part, the third horizontal transport part, and the third vertical transport part, the second supply state being a state in which, in accordance with the toner supply request from the developing device, toner is supplied to the developing device from the second toner container, the second vertical transport part, the second horizontal transport part, the third horizontal transport part, and the third vertical transport part, and in the first supply state, the drive control unit, in accordance with information that is detected by the first detection sensor and indicates a toner-less state in the first vertical transport part, controls the container driving unit and causes toner to be discharged from the first toner container to the first vertical transport part, and in accordance with the toner supply request, controls the first transport driving unit and the second transport driving unit to cause the first transport member and the third transport member to rotate in a state in which rotation of the second transport member is stopped, and in the second supply state, the drive control unit, in accordance with information that is detected by the second detection sensor and indicates a toner-less state in the second vertical transport part, controls the container driving unit and causes toner to be discharged from the second toner container to the second vertical transport part, and in accordance with the toner supply request, controls the first transport driving unit and the second transport driving unit to cause the second transport member and the third transport member to rotate in a state in which rotation of the first transport member is stopped. The counting unit accumulates a rotation time of the third transport member. The consumption amount calculation unit calculates a flow rate of toner flowing in the third horizontal transport part in each of the first supply state and the second supply state and thereby calculates a toner consumption amount of each of the first toner container and the second toner container in accordance with the rotation time accumulated by the counting unit.

DETAILED DESCRIPTION

Hereinafter, an image forming device 10 according to an embodiment of the present disclosure will be described in detail with reference to the drawings. In the present embodiment, description is provided of a tandem-type color printer as one example of an image forming device. The image forming device may be, for example, a copier, a facsimile device, a multifunctional printer incorporating a copier and a facsimile device, or the like. Further, the image forming device may be a printer, a copier, or the like that forms single-color (monochromatic) images.

Figure 1:
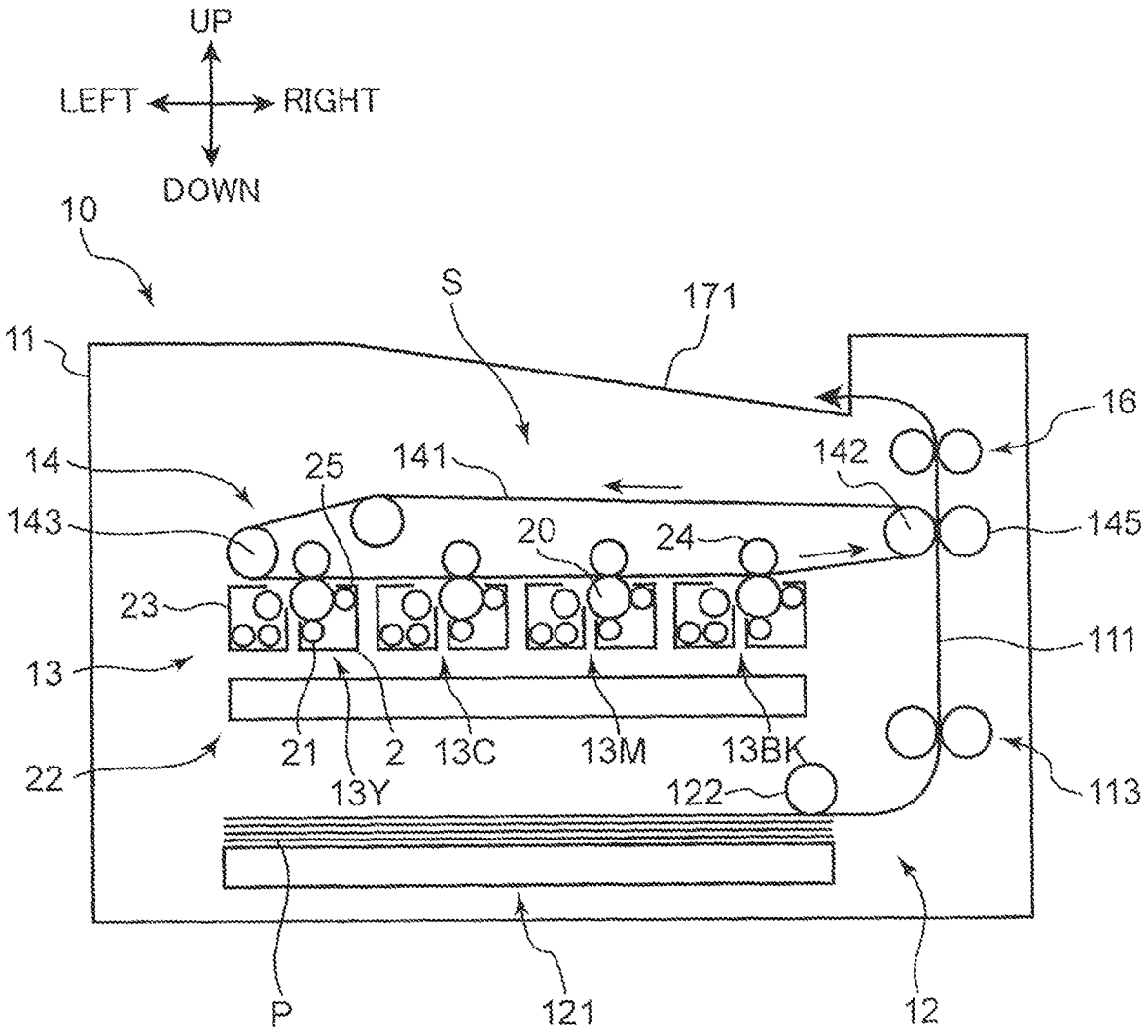
FIG. 1 is a cross-sectional view illustrating an internal structure of an image forming device according to an embodiment of the present disclosure.

FIG. 1 is a cross-sectional view illustrating the internal structure of the image forming device 10. The image forming device 10 includes a device main body 11 having a box-shaped housing structure. Inside the device main body 11: a sheet feeding unit 12 that feeds a sheet P; an image forming part 13 that forms a toner image to be transferred onto the sheet P fed from the sheet feeding unit 12; an intermediate transfer unit 14 at which primary transfer of the toner image takes place; a secondary transfer roller 145; and a fixing unit 16 that performs processing of fixing the unfixed toner image having been formed on the sheet P onto the sheet P are provided. Further, a sheet discharge part 171 is provided on the upper part of the device main body 11. The sheet P having been subjected to the fixing processing in the fixing unit 16 is discharged from the sheet discharge part 171.

Further, at the right side of the image forming part 13 inside the device main body 11, a sheet transport path 111 that extends in the vertical direction is formed. A transport roller pair that transports the sheet P is provided at an appropriate position along the sheet transport path 111. Further, a resist roller pair 113 that corrects the skew of the sheet P and sends the sheet P to a later-described secondary transfer nip part at a predetermined timing is also provided at the upstream side of this nip part along the sheet transport path 111. The sheet transport path 111 is a transport path that transport the sheet P from the sheet feeding unit 12 to the sheet discharge part 171, via the image forming part 13 (secondary transfer nip part) and the fixing unit 16.

The sheet feeding unit 12 includes: a sheet feeding tray 121; and a pickup roller 122. The sheet feeding tray 121 is attached to a lower position of the device main body 11 in insertable/removable state, and stores a sheet bundle in which a plurality of the sheets P are stacked. The pickup roller 122 feeds the uppermost sheet P of the sheet bundle stored in the sheet feeding tray 121 one by one.

The image forming part 13 forms a toner image to be transferred onto the sheet P, and includes a plurality of image forming units that form toner images of different colors. In the present embodiment, a yellow unit 13Y that uses yellow (Y) toner, a cyan unit 13C that uses cyan (C) toner, a magenta unit 13M that uses magenta (M) toner, and a black unit 13BK that uses black (BK) toner are provided as image forming units. These units are disposed in this order in correspondence with the toner of the plurality of colors from the upstream side to the downstream side (from the left side to the right side in FIG. 1) in the rotation direction of a later-described intermediate transfer belt 141. Each unit includes: a photoreceptor drum 20 and the following devices arranged around the photoreceptor drum 20: a charging device 21; a developing device 23; and a cleaning device 25. In addition, a light exposure device 22 shared by the units is arranged below the image forming units.

Figure 2:
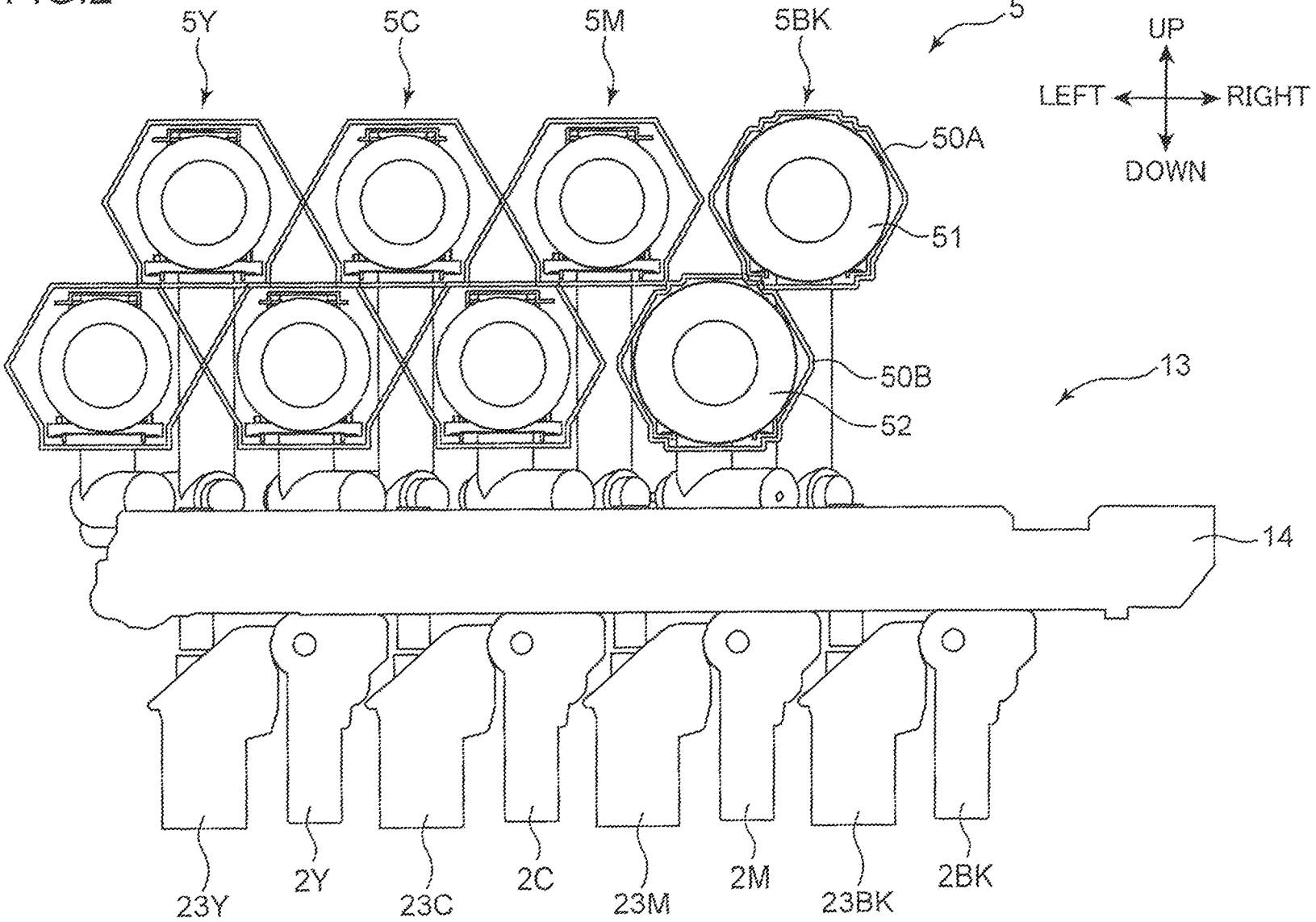
FIG. 2 is a front view of an image forming unit of the image forming device according to the embodiment of the present disclosure.

The photoreceptor drum 20 is rotationally driven about a predetermined axis extending in the front-rear direction, and has a circumferential surface that allows an electrostatic latent image to be formed and carries a toner image. The charging device 21 uniformly charges the surface of the photoreceptor drum 20. The light exposure device 22 has various optical devices such as a light source, a polygon mirror, a reflecting mirror, and a deflecting mirror, and irradiates the circumferential surface of the uniformly charged photoreceptor drum 20 with light modulated based on image data to form an electrostatic latent image. Further, the cleaning device 25 cleans the circumferential surface of the photoreceptor drum 20 after a toner image has been transferred. In the present embodiment, the photoreceptor drum 20, the charging device 21, and the cleaning device 25 are integrated with one other to constitute a drum unit 2 (FIGS. 1 and 2).

The developing device 23 supplies toner onto the circumferential surface of the photoreceptor drum 20 in order to develop (visualize) an electrostatic latent image having been formed on the photoreceptor drum 20 into a toner image. The developing device 23 accommodates therein magnetic one-component toner as a developer. In the present embodiment, the toner has a characteristic such that the toner is capable of being charged to the positive polarity. In another embodiment, the developing device 23 may adopt other developing methods, such as a method in which a two-component developer constituted of toner and a carrier is used or a method in which a non-magnetic one component developer is used.

The intermediate transfer unit 14 is arranged above the image forming part 13. The intermediate transfer unit 14 includes: an intermediate transfer belt 141; a driving roller 142; a driven roller 143; and primary transfer rollers 24.

The intermediate transfer belt 141 is an endless belt-shaped rotating body, and is suspended across the driving roller 142 and the driven roller 143 so that the circumferential surface-side of the intermediate transfer belt 141 contacts the circumferential surface of each photoreceptor drum 20. The intermediate transfer belt 141 is driven to rotate in one direction and carries toner images transferred thereon from the photoreceptor drums 20 on the surface thereof.

The driving roller 142 holds the intermediate transfer belt 141 in tensioned state at the left end-side of the intermediate transfer unit 14 and drives the intermediate transfer belt 141 to rotate. The driving roller 142 is constituted of a metal roller. The driven roller 143 holds the intermediate transfer belt 141 in tensioned state at the right end-side of the intermediate transfer unit 14. The driven roller 143 applies tension to the intermediate transfer belt 141.

Each primary transfer roller 24 forms a primary transfer nip part with a photoreceptor drum 20 with the intermediate transfer belt 141 therebetween, and performs primary transfer of the toner image on the photoreceptor drum 20 onto the intermediate transfer belt 141. For the photoreceptor drum 20 of each color, an opposing primary transfer roller 24 is arranged.

The secondary transfer roller 145 is arranged to oppose the driving roller 142 with the intermediate transfer belt 141 therebetween. The secondary transfer roller 145 is pressed against the circumferential surface of the intermediate transfer belt 141 to form the secondary transfer nip part. The toner image having been primarily transferred onto the intermediate transfer belt 141 undergoes secondary transfer onto the sheet P supplied from the sheet feeding unit 12 at the secondary transfer nip part. The intermediate transfer unit 14 and the secondary transfer roller 145 of the present embodiment constitute a transfer unit of the present disclosure. The transfer unit transfers the toner image having been formed in the image forming part 13 from the photoreceptor drums 20 onto the sheet P.

The sheet P supplied to the fixing unit 16 passes through the fixing nip part and is thereby heated and pressurized. As a result, the toner image having been transferred onto the sheet P at the secondary transfer nip part is fixed onto the sheet P.

The sheet discharge part 171 is formed by the top part of the device main body 11 being recessed. The sheet P having been subjected to the fixing processing is discharged onto the sheet discharge part 171 via the sheet transport path 111, which is disposed to extend from the upper part of the fixing unit 16.

Figure 3:
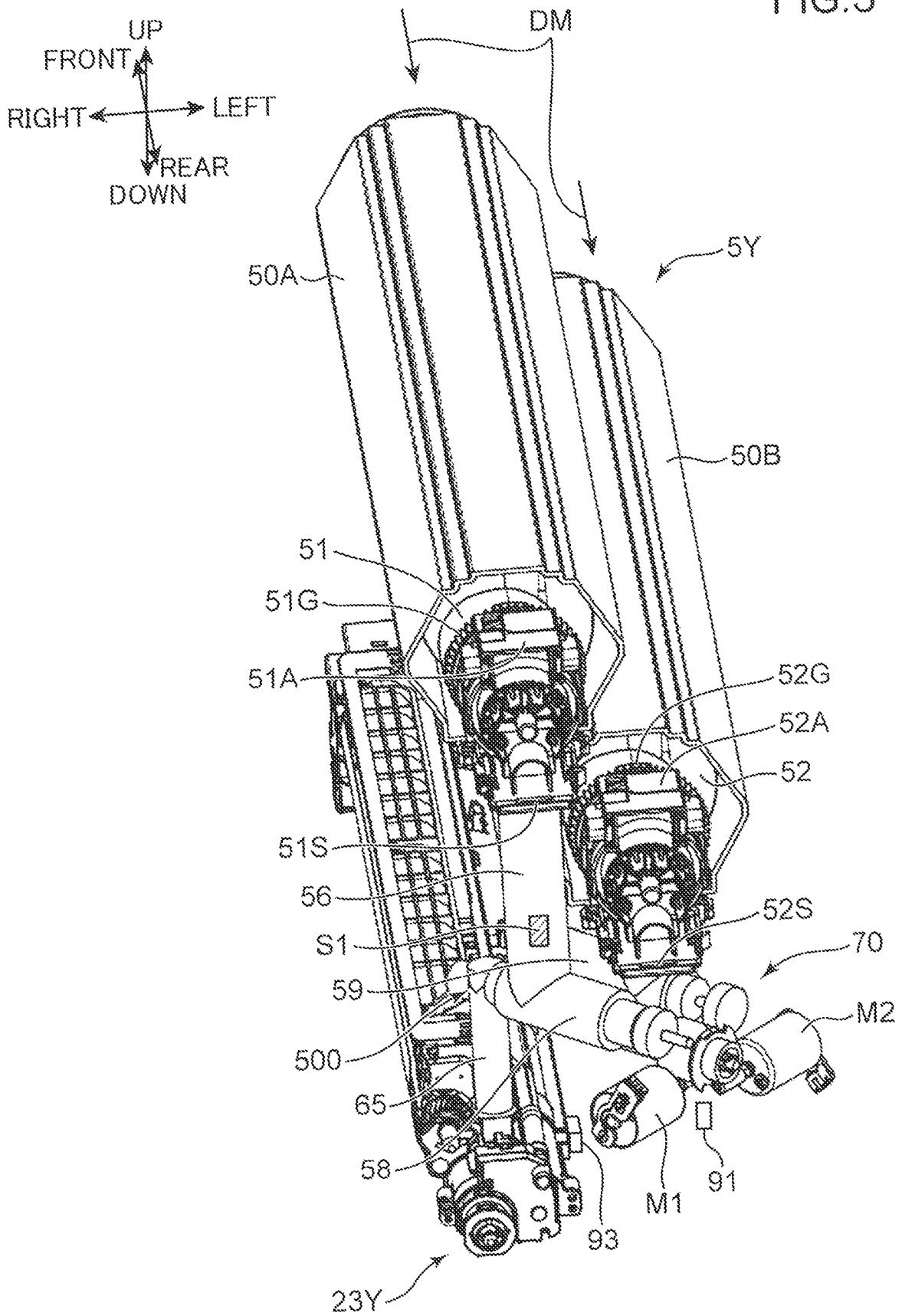
FIG. 3 is a perspective view of a toner supplying unit and a developing device of the image forming device according to the embodiment of the present disclosure.
Figure 4:
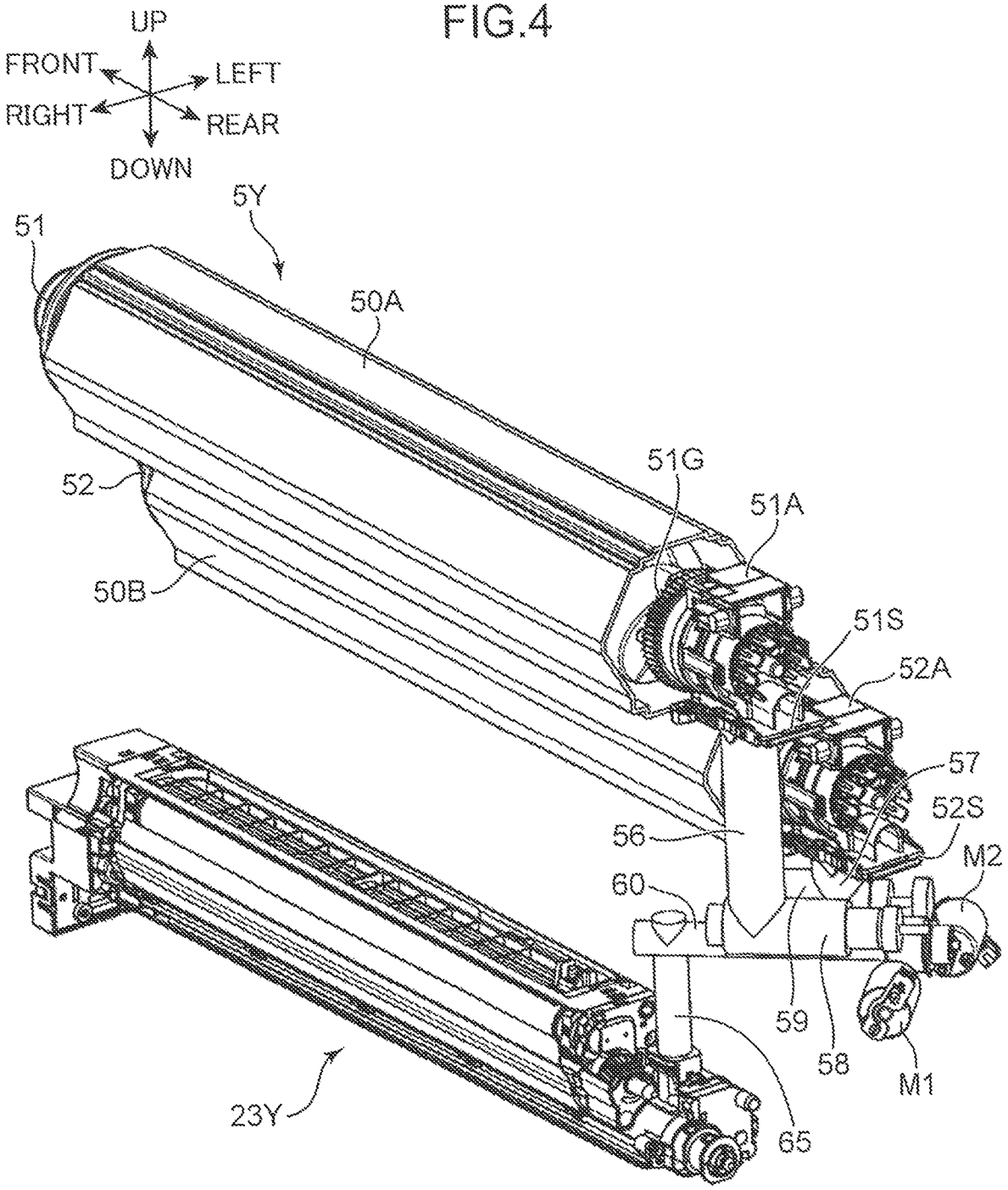
FIG. 4 is a perspective view of the toner supplying unit and the developing device of the image forming device according to the embodiment of the present disclosure.

FIG. 2 is a front view of the image forming part 13 of the image forming device 10 according to the present embodiment. FIGS. 3 and 4 are perspective views of a toner supplying unit 5Y and a developing device 23Y for the color yellow, in the image forming device 10 according to the present embodiment.

With reference of FIGS. 2 to 4, the image forming device 10 further includes toner supplying units 5 corresponding to the respective colors. The toner supplying units 5 supply toner to the developing devices 23 of the respective colors. In the present embodiment, toner supplying units 5 (5BK, 5M, 5C, 5Y) of the respective colors are arranged adjacent to one other in the horizontal direction, as illustrated in FIG. 2. Since the toner supplying units 5 of the respective colors have the same structure and the developing devices 23 of the respective colors have the same structure, description is provided in the following based on the toner supplying unit 5Y and the developing device 23Y for the color yellow, as necessary.

The toner supplying units 5 of the respective colors each have: an upper toner container 51 (a first toner container); a lower toner container 52 (a second toner container); an upper housing 50A; and a lower housing 50B.

The upper toner container 51 and the lower toner container 52 each extend along the axial direction of the photoreceptor drums 20, and is configured to be capable of storing toner therein and discharging the toner. The upper toner container 51 and the lower toner container 52 are mounted onto the device main body 11 of the image forming device 10 along a mounting direction DM (the rear direction in FIG. 3). The mounting direction DM is parallel to the axial direction of the photoreceptor drums 20. In the present embodiment, the upper toner container 51 and the lower toner container 52 are provided with a cylindrical shape, and spiral grooves extending spirally along the axial direction are formed on the outer circumferential surfaces thereof. The spiral grooves form spiral protrusions protruding into the space inside the upper toner container 51 and space inside the lower toner container 52. Further, the upper toner container 51 and the lower toner container 52 are rotated by a later-described container driving unit MC, whereby the toner inside is transported toward the rear by the spiral protrusions. The upper toner container 51 has: a fixed part 51A; and a first container gear 51G (FIG. 3). The fixed part 51A does not rotate, and the portion of the upper toner container 51 further toward the front than the fixed part 51A is configured to be capable of rotating relative to the fixed part 51A. The first container gear 51G is a gear that is fixed to the outer circumferential part of the upper toner container 51 at the front of the fixed part 51A. Rotational force is transmitted from the container driving unit MC to the first container gear 51G, whereby the front portion of the upper toner container 51 rotates.

Similarly, the lower toner container 52 has: a fixed part 52A; and a second container gear 52G (FIG. 3). The fixed part 52A does not rotate, and the portion of the lower toner container 52 further toward the front than the fixed part 52A is configured to be capable of rotating relative to the fixed part 52A. The second container gear 52G is a gear that is fixed to the outer circumferential part of the lower toner container 52 at the front of the fixed part 52A. Rotational force is transmitted from the container driving unit MC to the second container gear 52G, whereby the front portion of the lower toner container 52 rotates.

Note that the upper toner container 51 has a toner discharge port 510 (see FIG. 7) formed in the front end-side thereof (the fixed part 51A) in the mounting direction DM, which is the direction in which the upper toner container 51 is mounted onto the upper housing 50A, and the lower toner container 52 has an undepicted toner discharge port formed in the front end-side thereof (the fixed part 52A) in the mounting direction DM, which is the direction in which the lower toner container 52 is mounted onto the lower housing 50B. Toner is discharged from these toner discharge ports. Further, the upper toner container 51 and the lower toner container 52 are provided with shutters 51S and 52S (FIGS. 3 and 4) for sealing the toner discharge ports. When the upper toner container 51 and the lower toner container 52 are mounted onto the upper housing 50A and the lower housing 50B, these shutters are slidingly moved to open the respective toner discharge ports, as will be described later. Further, in the present embodiment, the upper toner container 51 and the lower toner container 52 are toner containers of the same shape. In other words, the toner container of each color applied to the image forming device 10 can be mounted onto either one of the upper housing 50A and the lower housing 50B in the toner supplying unit 5 of the corresponding color. Note that the upper toner container 51 and the lower toner container 52 of each color are arranged in a container space S of the device main body 11 illustrated FIG. 1.

In the device main body 11, the upper housing 50A is arranged above the developing device 23 with a space therebetween. The upper housing 50A allows the upper toner container 51 to be mounted inside the upper housing 50A along the mounting direction DM and accommodates the upper toner container 51. In the device main body 11, the lower housing 50B is arranged above the developing device 23 and below the upper housing 50A. The lower housing 50B allows the lower toner container 52 to be mounted inside the lower housings 50B along the mounting direction DM and accommodates the lower toner container 52.

With reference to FIG. 3, note that in the present embodiment, the lower housing 50B positions the lower toner container 52 inside the device main body 11 so that the mounting direction front end part of the lower toner container 52 (i.e., the rear end part of the lower toner container 52) is arranged at the same position in the mounting direction as the mounting direction front end part of the upper toner container 51 mounted onto the upper housing 50A (i.e., the rear end part of the upper toner container 51). Further, in the device main body 11, the lower housing 50B is arranged at a position that is above the developing device 23, is below the upper housing 50A, and is shifted toward the left with respect to the upper housing 50A in a direction (the left-right direction) that is horizontal and is perpendicular to the axial direction of the photoreceptor drums 20 (FIG. 2 to FIG. 4). As a result, a later-described first vertical transport part 56 can be arranged in a space that is below the mounting direction front end part of the upper toner container 51 (i.e., the rear end part of the upper toner container 51) and faces the mounting direction front end part of the lower toner container 52 in the direction that is horizontal and is perpendicular to the axial direction of the photoreceptor drums 20, without interfering with the lower toner container 52.

Figure 5:
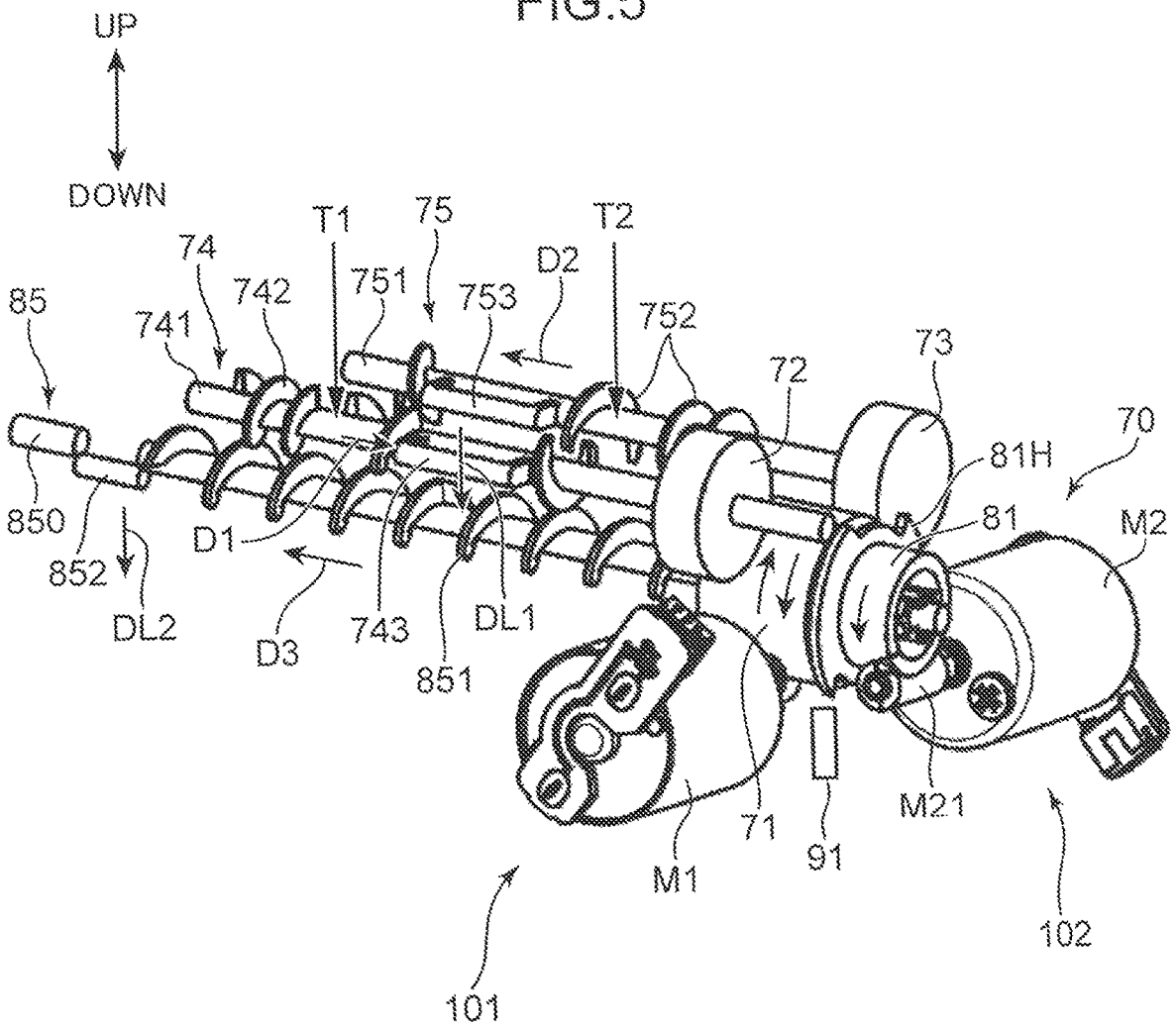
FIG. 5 is a perspective view of a first transport driving unit, a second transport driving unit, a first transport member, a second transport member, and a third transport member according to the embodiment of the present disclosure.
Figure 6:
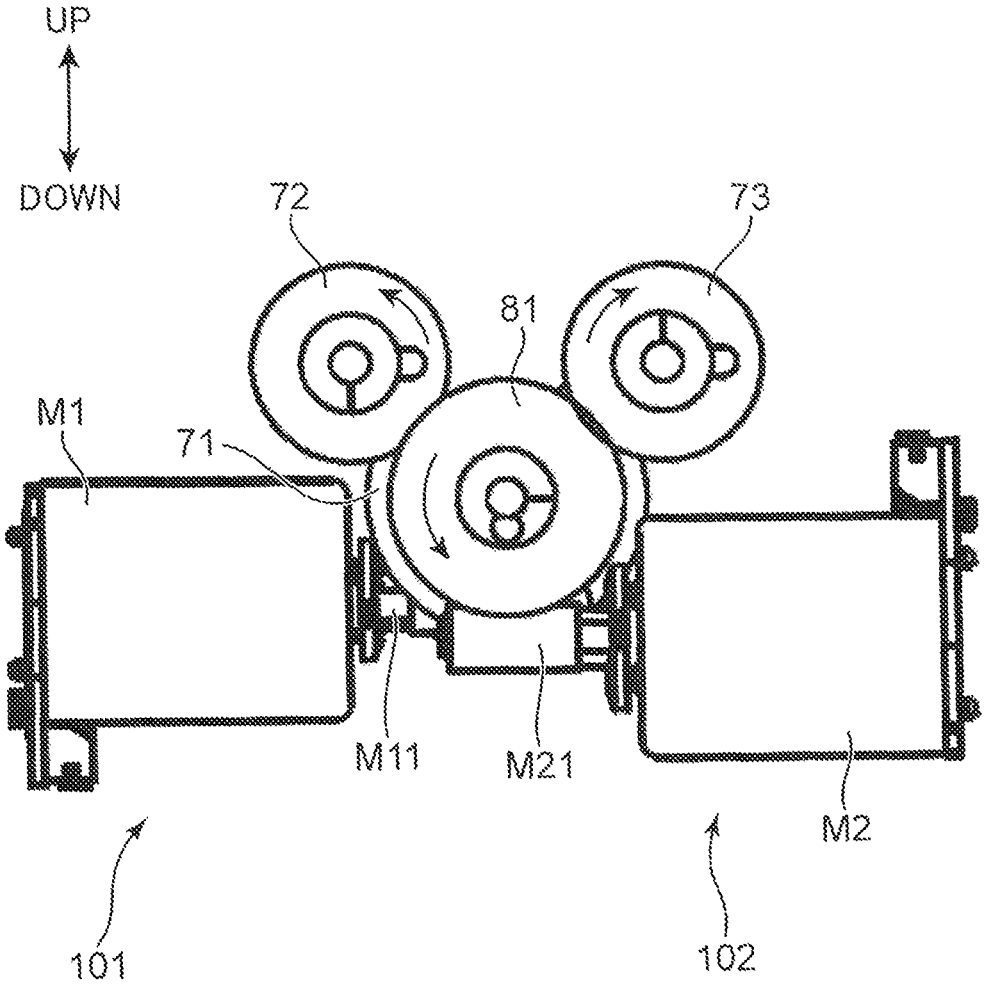
FIG. 6 is a lateral view of the first transport driving unit, the second transport driving unit, the first transport member, the second transport member, and the third transport member according to the embodiment of the present disclosure.

FIG. 5 is a perspective view of a first transport driving unit 101, a second transport driving unit 102, a first transport screw 74, a second transport screw 75, and a third transport screw 85 according to the present embodiment, and FIG. 6 is a lateral view of the same.

Figure 8:
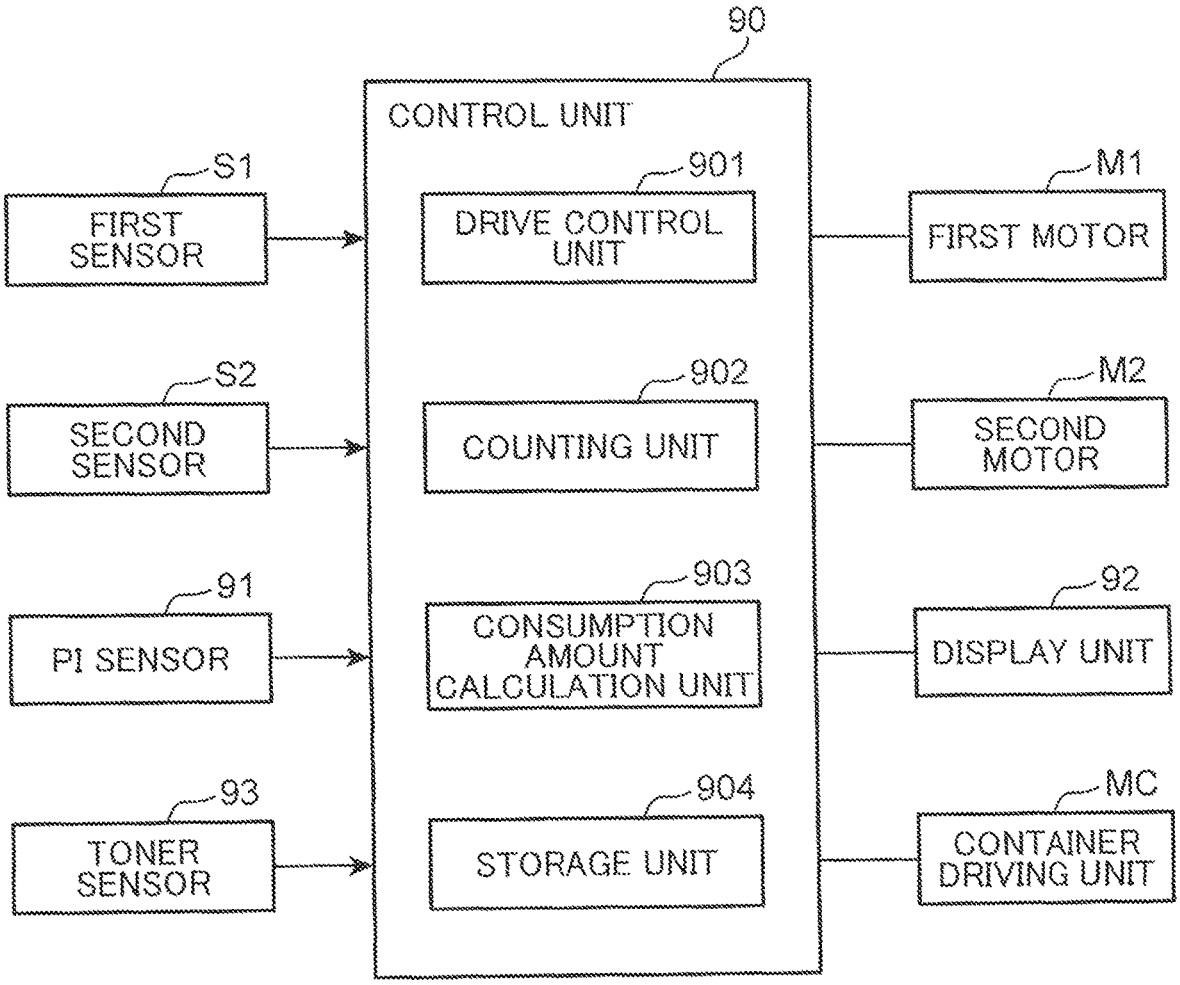
FIG. 8 is a block diagram of a control unit of the image forming device according to the embodiment of the present disclosure.

The toner supplying unit 5 further includes: a first vertical transport part 56; a second vertical transport part 57; a first horizontal transport part 58; a second horizontal transport part 59; a merging part 500 (a horizontal merging part 60 and a third vertical transport part 65); the first transport screw 74 (a first transport member); the second transport screw 75 (a second transport member); the third transport screw 85 (a third transport member); a screw driving unit 70; the container driving unit MC (FIG. 8); a first sensor S1 (a first detection sensor); a second sensor S2 (a second detection sensor); and a control unit 90 (FIG. 8).

The first vertical transport part 56 is a pipe-shaped member provided to the device main body 11 so as to extend downward from near the first container shutter 51S. The first vertical transport part 56 guides toner discharged from the upper toner container 51 downward along the vertical direction. Therefore, when the upper toner container 51 is mounted onto the upper housing 50A, the first vertical transport part 56 and the fixed part 51A of the upper toner container 51 communicate with one another.

The second vertical transport part 57 is a pipe-shaped member provided to the device main body 11 so as to extend downward from near the second container shutter 52S. The second vertical transport part 57 guides toner discharged from the lower toner container 52 downward along the vertical direction. Therefore, when the lower toner container 52 is mounted onto the lower housing 50B, the second vertical transport part 57 and the fixed part 52A of the lower toner container 52 communicate with one another.

The first horizontal transport part 58 is a pipe-shaped member extending in the horizontal direction. The first horizontal transport part 58 receives toner from the first vertical transport part 56 and transfers the toner to the merging part 500 (the horizontal merging part 60) while transporting the toner toward the rear left (a first direction) along the horizontal direction. In other words, the first horizontal transport part 58 communicates with the lower end part of the first vertical transport part 56, and guides the toner flowing in from the first vertical transport part 56 in the first direction along the horizontal direction.

The second horizontal transport part 59 is a pipe-shaped member extending in the horizontal direction. The second horizontal transport part 59 receives toner from the second vertical transport part 57 and transfers the toner to the merging part 500 (the horizontal merging part 60) while transporting the toner toward the front right (a second direction) along the horizontal direction. In other words, the second horizontal transport part 59 communicates with the lower end part of the second vertical transport part 57, and guides the toner flowing in from the second vertical transport part 57 along the second direction.

The first transport screw 74 (FIG. 5) is rotatably arranged in the first horizontal transport part 58 and transports toner in the first direction (arrow D1 in FIG. 5). The first transport screw 74 has: a first shaft 741; a first main transport blade 742; and a first paddle 743.

The first shaft 741 serves as the rotation axis of the rotation of the first transport screw 74. The first main transport blade 742 is a spiral blade arranged on the first shaft 741. The first paddle 743 is a paddle arranged on the first shaft 741 and sends toner into the horizontal merging part 60 (arrow DL1 in FIG. 5). The first main transport blade 742 transports toner from the position (see arrow T1 in FIG. 5) at which toner flows into the first horizontal transport part 58 from the first vertical transport part 56 toward the first paddle 743 at the rear.

The second transport screw 75 (FIG. 5) is rotatably arranged in the second horizontal transport part 59 and transports toner in the second direction (arrow D2 in FIG. 5). The second transport screw 75 has: a second shaft 751; a second main transport blade 752; and a second paddle 753.

The second shaft 751 serves as the rotation axis of the rotation of the second transport screw 75. The second main transport blade 752 is a spiral blade arranged on the second shaft 751. The second paddle 753 is a paddle arranged on the second shaft 751 and sends toner into the horizontal merging part 60 (arrow DL1 in FIG. 5). The second main transport blade 752 transports toner from the position (see arrow T2 in FIG. 5) at which toner flows into the second horizontal transport part 59 from the second vertical transport part 57 toward the second paddle 753 at the front.

The merging part 500 communicates with each of the first horizontal transport part 58 and the second horizontal transport part 59. The merging part 500 receives therein the toner transported by the first transport screw 74 and the toner transported by the second transport screw 75, and transports the toner toward the developing device 23 (23Y in FIG. 3). The merging part 500 has: the horizontal merging part 60 (a third horizontal transport part); and a third vertical transport part 65.

The horizontal merging part 60 has a pipe shape arranged to extend in parallel with the first horizontal transport part 58 and the second horizontal transport part 59 below the first horizontal transport part 58 and the second horizontal transport part 59. The horizontal merging part 60 communicates, through a same undepicted opening, with each of a first direction downstream portion (below the first paddle 743) of the first horizontal transport part 58 and a second direction downstream portion (below the second paddle 753) of the second horizontal transport part 59, and receives therein the toner transported by the first transport screw 74 and the toner transported by the second transport screw 75. Further, the horizontal merging part 60 guides the toner so received toward the front right (a third direction; arrow D3 in FIG. 5) along the horizontal direction. The horizontal merging part 60 has the third transport screw 85 (the third transport member), which is rotatably arranged inside the pipe shape (FIG. 5). The third transport screw 85 has the function of transporting toner in the third direction inside the horizontal merging part 60. The third transport screw 85 has: a third shaft 850; a third main transport blade 851; and a third paddle 852.

The third shaft 850 (FIG. 5) serves as the rotation axis of the rotation of the third transport screw 85. The third main transport blade 851 is a spiral blade arranged on the third shaft 850. The third main transport blade 851 causes the toner received from the first horizontal transport part 58 (the first transport screw 74) and the second horizontal transport part 59 (the second transport screw 75) to flow into the third vertical transport part 65 while transporting the toner toward the front right (the third direction) along the horizontal direction. The third paddle 852 is a paddle arranged on the third shaft 850 at the downstream side of the third main transport blade 851. The third paddle 852 helps the toner that is transported by the third main transport blade 851 as the third transport screw 85 rotates to flow into the third vertical transport part 65 (arrow DL2 in FIG. 5).

The third vertical transport part 65 has a pipe shape arranged to extend downward along the vertical direction from the third direction downstream portion of the horizontal merging part 60. The upper end part of the third vertical transport part 65 communicates with the horizontal merging part 60 and the lower end part of the third vertical transport part 65 communicates with the developing device 23Y. That is, the third vertical transport part 65 guides the toner transported by the third transport screw 85 to the developing device 23 along the vertical direction.

The screw driving unit 70 (FIG. 3) generates driving force for causing the first transport screw 74, the second transport screw 75, and the third transport screw 85 to rotate. The screw driving unit 70 includes: the first transport driving unit 101; the second transport driving unit 102; and a PI sensor 91. The first transport driving unit 101 includes: a first motor M1; a first worm wheel 71 (a first intermediate gear); a first one-way gear 72 (a one-way clutch; a first transmission member); and a second one-way gear 73 (a one-way clutch; a second transmission member). The second transport driving unit 102 includes: a second motor M2; and a second worm wheel 81 (a second intermediate gear).

The first motor M1 is a motor that is configured to be rotatable in a first rotation direction and a second rotation direction opposite the first rotation direction. The rotation, the stopping, and the rotation direction of the first motor M1 are controlled by a drive control unit 901 of the later-described control unit 90. As a result, the first motor M1 generates driving force for selectively driving the first transport screw 74 or the second transport screw 75 to rotate.

The first worm wheel 71 is connected to an output shaft M11 (FIG. 6) of the first motor M1. The first worm wheel 71 is configured so that the first worm wheel 71 can also rotate in different rotation directions depending upon the rotation direction of the first motor M1. The first worm wheel 71 is rotatably supported by an end part of the third shaft 850 of the third transport screw 85. Note that the first worm wheel 71 and the third transport screw 85 rotate independently of one another other. The first worm wheel 71 is arranged coaxially with the third transport screw 85 at one end side of the third transport screw 85, and receives the end of the third transport screw 85 therein (allows one end of the third transport screw 85 to be inserted therethrough). Further, the first worm wheel 71 is rotatable relative to the third transport screw 85. The first worm wheel 71 transmits rotational driving force of the first motor M1 to the first one-way gear 72 and the second one-way gear 73. According to such a configuration, the space occupied by the first transport driving unit 101 and the second transport driving unit 102 can be made compact, as illustrated in FIG. 5.

The first one-way gear 72 is a gear engaged with the first worm wheel 71, and is fixed to one end of the first shaft 741 of the first transport screw 74. When rotational driving force is transmitted from the first worm wheel 71 to the first one-way gear 72, the first transport screw 74 rotates and toner is transported. The first one-way gear 72 is interposed between the first motor M1 and the first transport screw 74. The first one-way gear 72 allows the first transport screw 74 to rotate when the first motor M1 is rotated in the first rotation direction, whereas the first one-way gear 72 inhibits the first transport screw 74 from rotating when the first motor M1 is rotated in the second rotation direction.

Similarly, the second one-way gear 73 is a gear engaged with the first worm wheel 71 at a position differing from the position at which the first one-way gear 72 is engaged with the first worm wheel 71, and is fixed to one end of the second shaft 751 of the second transport screw 75. When rotational driving force is transmitted from the first worm wheel 71 to the second one-way gear 73, the second transport screw 75 rotates and toner is transported. The second one-way gear 73 is interposed between the first motor M1 and the second transport screw 75. The second one-way gear 73 allows the second transport screw 75 to rotate when the first motor M1 is rotated in the second rotation direction, whereas the second one-way gear 73 inhibits the second transport screw 75 from rotating when the first motor M1 is rotated in the first rotation direction.

The second motor M2 is a motor that is configured to be rotatable in a predetermined rotation direction. The second motor M2 generates driving force for rotating the third transport screw 85. The rotation, the stopping, and the rotation direction of the second motor M2 are controlled by the drive control unit 901 of the later-described control unit 90. The second motor M2 is provided with an output shaft M21.

The second worm wheel 81 is a gear engaged with the output shaft M21 (FIG. 6) of the second motor M2, and is fixed to an end part of the third shaft 850 of the third transport screw 85. Therefore, the second worm wheel 81 and the third transport screw 85 rotate integrally. That is, the second worm wheel 81 has the function of transmitting rotational driving force of the second motor M2 to the third transport screw 85. The second worm wheel 81 is provided with a detection-target piece 81H. The detection-target piece 81H is fixed to one end of the second worm wheel 81 in the axial direction, and has a pair of slits formed therein in the circumferential direction, as illustrated in FIG. 5. The rotation of the detection-target piece 81H is detected by the PI sensor 91, whereby the rotation count (cumulative rotation count) of the third transport screw 85 is detected.

As described above, the PI sensor 91 is arranged in the device main body 11 of the image forming device 10 so as to face the detection-target piece 81H of the second worm wheel 81. The PI sensor 91 includes: an undepicted emission unit for emitting detection light; and a light reception unit for receiving the detection light. The detection-target piece 81H blocks the detection light while the slit portions of the detection-target piece 81H allow the detection light to pass through, whereby the rotation of the second worm wheel 71, or that is, the rotation of the third transport screw 85 is detected.

The container driving unit MC (FIG. 8) generates driving force for selectively discharging toner from the upper toner container 51 or the lower toner container 52. In the present embodiment, the container driving unit MC includes an undepicted motor connected to each of the first container gear 51G and the second container gear 52G. The motor may be arranged one for each of the first container gear 51G and the second container gear 52G. Alternatively, the motor may be such that the first container gear 51G or the second container gear 52G is selectively rotated depending upon the rotation direction of one motor, similarly to the above-described screw driving unit 70. Note that the toner discharge amount from the upper toner container 51 and the lower toner container 52 is desirably set to be greater than the toner supply amount required at the developing device 23.

The first sensor S1 (FIGS. 3 and 8) is arranged to face the lower end part of the first vertical transport part 56, and detects whether or not toner is present inside the pipe of the first vertical transport part 56. Similarly, the second sensor S2 (FIG. 8) is arranged to face the lower end part of the second vertical transport part 57, and detects whether or not toner is present inside the pipe of the second vertical transport part 57. These sensors are constituted of magnetic permeability sensors. When a sufficient amount of toner is present inside the first vertical transport part 56 or the second vertical transport part 57, the corresponding sensor outputs a HIGH signal (+5V). Meanwhile, when hardly any toner is present inside the first vertical transport part 56 or the second vertical transport part 57, the corresponding sensor outputs a LOW signal (0V). In other embodiments, these sensors may be PI sensors (photosensors). In such a case, the first vertical transport part 56 and the second vertical transport part 57 are constituted of transparent pipe members, and whether or not colored toner is present inside the first vertical transport part 56 and the second vertical transport part 57 is detected by the PI sensors. Further, the first sensor S1 and the second sensor S2 may be other optical sensors (transmission sensors, reflection sensors), piezoelectric sensors, etc.

With reference to FIGS. 2 and 3, the upper toner container 51, which has a cylindrical shape extending along a predetermined longitudinal direction, is configured to be attachable and detachable to and from a first position inside the device main body 11, and the lower toner container 52, which has the same shape as the upper toner container 51, is configured to be attachable and detachable to and from a second position that is below the first position inside the device main body 11. Further, the lower toner container 52 having been mounted onto the second position is arranged at a position shifted toward the left from the upper toner container 51 having been mounted onto the first position. Here, the upper toner container 51 and the lower toner container 52 are respectively mounted onto the first position and the second position along the mounting direction DM, which is parallel to the longitudinal direction. Meanwhile, the vertical direction length of the first vertical transport part 56 is set longer than the vertical direction length of the second vertical transport part 57.

Figure 7:
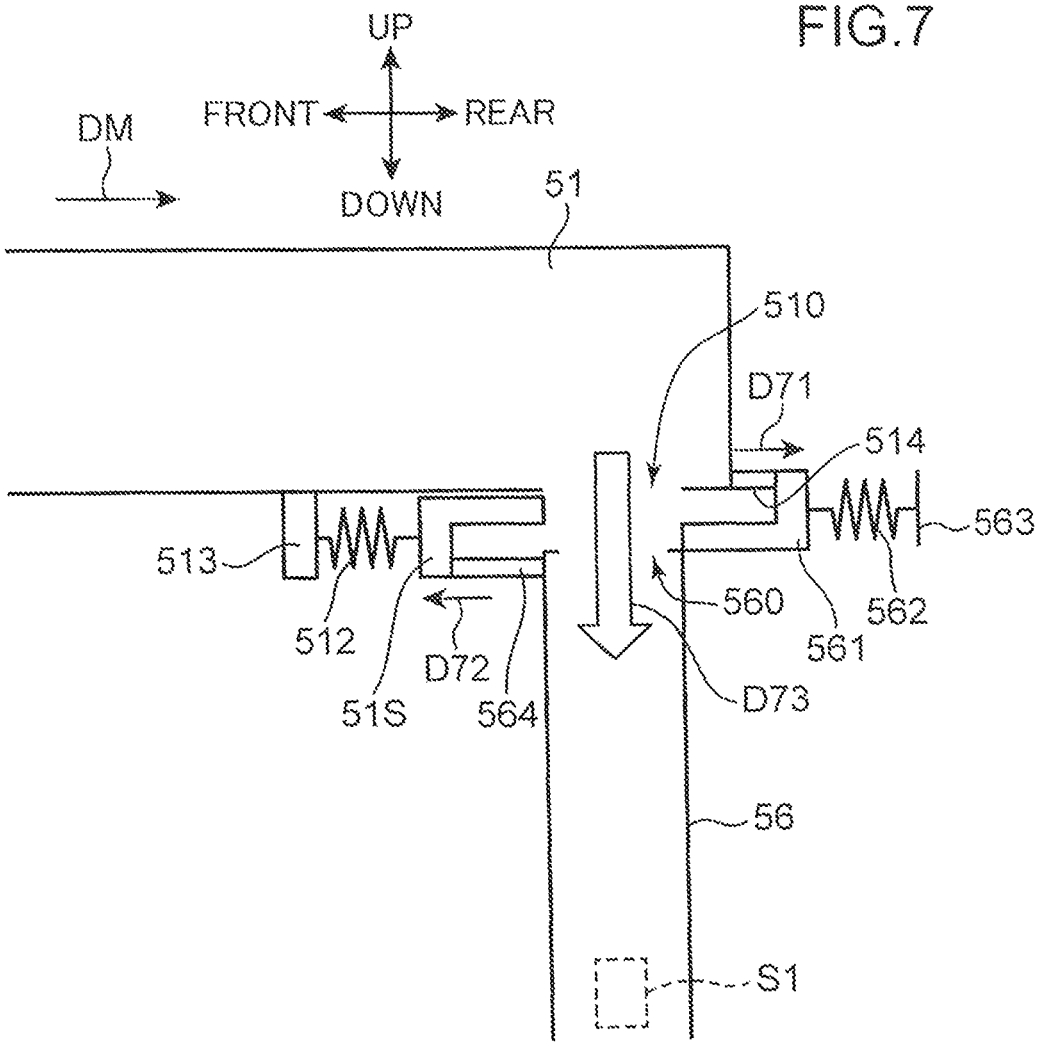
FIG. 7 is a schematic cross-sectional view illustrating a state in which a toner container is being mounted onto the image forming device according to the embodiment of the present disclosure.

FIG. 7 is a schematic cross-sectional view illustrating a state in which the upper toner container 51 is being attached to the device main body 11 of the image forming device 10 according to the present embodiment. Note that the lower toner container 52 and the second vertical transport part 57 also have structures similar to the structures illustrated in FIG. 7. In addition to the above-described first container shutter 51S, the upper toner container 51 has: the toner discharge port 510; a spring 512; a spring fixing part 513; and a shutter pressing part 514. The toner discharge port 510 is opened at the front end part of the upper toner container 51, and allows toner to be discharged. The first container shutter 51S is held by the main body portion of the upper toner container 51 to be slidingly-movable along the front-rear direction. The first container shutter 51S opens and seals the toner discharge port 510. The first container shutter 51S has an L shape in lateral view. The spring 512 biases the first container shutter 51S in the direction in which the first container shutter 51S seals the toner discharge port 510. The base end part of the spring 512 is fixed to the spring fixing part 513, which is disposed to protrude from the main body portion of the upper toner container 51. The shutter pressing part 514 is a protrusion protruding toward the rear from the front end part of the upper toner container 51.

Meanwhile, the first vertical transport part 56 has: a toner inflow port 560; a main body-side shutter 561; a spring 562; and a spring fixing part 563. The toner inflow port 560 is an opening opened at the upper end part of the first vertical transport part 56, and receives toner from the toner discharge port 510. The main body-side shutter 561 is supported by the upper end part of the first vertical transport part 56 to be slidingly-movable in the front-rear direction. The main body-side shutter 561 opens and seals the toner inflow port 560. The main body-side shutter 561 has an L shape in lateral view. The spring 562 biases the main body-side shutter 561 in the direction in which the main body-side shutter 561 seals the toner inflow port 560. The base end part of the spring 562 is fixed to the spring fixing part 563. A shutter pressing part 564 is a protrusion disposed to protrude toward the front from the upper end part of the first vertical transport part 56 at the opposite side from the spring 562.

When the upper toner container 51 is mounted onto the first position (FIGS. 2 and 3) of the device main body 11 along the direction of the arrow DM in FIG. 7, the shutter pressing part 514 of the upper toner container 51 pushes the main body-side shutter 561 toward the rear (arrow D71), whereby the toner inflow port 560 opens while the spring 562 is compressed. Meanwhile, when the upper toner container 51 is mounted, the shutter pressing part 564 of the first vertical transport part 56 pushes the first container shutter 51S toward the rear (arrow D72). As a result, the toner discharge port 510 opens while the spring 512 is compressed. That is, the toner discharge port 510 and the toner inflow port 560 are put in communication with one another.

Hence, in the present embodiment, a configuration is made so that, when the upper toner container 51 is mounted onto the first position inside the device main body 11, at least a part of the toner in the upper toner container 51 is capable of flowing into the first vertical transport part 56 by free fall (arrow D73). Similarly, a configuration is made so that, when the lower toner container 52 is mounted onto the second position inside the device main body 11, at least a part of the toner in the lower toner container 52 is capable of flowing into the second vertical transport part 57 by free fall. Accordingly, when a new upper toner container 51 is mounted after the first vertical transport part 56 becomes empty of toner therein, the first sensor S1 detects the toner that has freely fallen and the control unit 90 is thereby capable of detecting that the upper toner container 51 has been replaced. The same applies to the lower toner container 52.

FIG. 8 is a block diagram of the control unit 90 of the image forming device 10 according to the present embodiment. The control unit 90 is constituted of: a central processing unit (CPU); a read only memory (ROM) that stores a control program; a random access memory (RAM) that is used as the CPU working area; etc. In addition to the first sensor S1, the second sensor S2, the PI sensor 91, the container driving unit MC, the first motor M1, and the second motor M2, which have been described above, a display unit 92, a toner sensor 93, etc., are electrically connected to the control unit 90. Further, the control unit 90 is connected to a network in order to transmit operation information and failure information of the image forming device 10 to an information management center located at a remote location.

The toner sensor 93 (FIGS. 3 and 8) is provided to each developing device 23 (23Y), and outputs a detection signal that is in accordance with the amount of toner inside the developing device 23. When the amount of toner inside the developing device 23 is equal to or more than a predetermined threshold value, the toner sensor 93 outputs a HIGH signal (+5V). Meanwhile, when the amount of toner inside the developing device 23 is less than the predetermined threshold value, the toner sensor 93 outputs a LOW signal (0V). The toner sensor 93 may be configured so that the more the amount of toner inside the developing device 23, the greater the detection signal (voltage) that is output. The detection signal output by the toner sensor 93 is referred to by the drive control unit 901 of the control unit 90 as a toner supply request from the developing device 23.

The display unit 92 is provided to an undepicted operation unit of the image forming device 10. The display unit 92 displays information for operating the image forming device 10, the operation state of the image forming device 10, etc.

By the CPU executing the control program stored in the ROM, the control unit 90 functions to include: the drive control unit 901; a counting unit 902; a consumption amount calculation unit 903; and a storage unit 904.

The drive control unit 901 controls the drive of the first motor M1, the second motor M2, and the container driving unit MC. The drive control unit 901 performs switching between a first supply state and a second supply state. In the first supply state, in accordance with the toner supply request from the developing device 23 (23Y), toner is supplied to the developing device 23 from the upper toner container 51, the first vertical transport part 56, the first horizontal transport part 58, the horizontal merging part 60, and the third vertical transport part 65. In the second supply state, in accordance with the toner supply request from the developing device 23 (23Y), toner is supplied to the developing device 23 from the lower toner container 52, the second vertical transport part 57, the second horizontal transport part 59, the horizontal merging part 60, and the third vertical transport part 65.

In the first supply state, the drive control unit 901, in accordance with a LOW signal (information indicating toner-less state in the first vertical transport part 56) detected by the first sensor S1, controls the container driving unit MC and thereby causes toner to be discharged from the upper toner container 51 to the first vertical transport part 56, and also, the drive control unit 901, in accordance with the toner supply request, controls the first motor M1 to drive in the first rotation direction and causes the first transport screw 74 to rotate in a state in which the rotation of the second transport screw 75 is stopped, and also controls the second motor M2 to drive and thereby causes the third transport screw 85 to rotate.

Meanwhile, in the second supply state, the drive control unit 901, in accordance with a LOW signal (information indicating toner-less state in the second vertical transport part 57) detected by the second sensor S2, controls the container driving unit MC and thereby causes toner to be discharged from the lower toner container 52 to the second vertical transport part 57, and also, the drive control unit 901, in accordance with the toner supply request, controls the first motor M1 to drive in the second rotation direction and causes the second transport screw 75 to rotate in a state in which the rotation of the first transport screw 74 is stopped, and also controls the second motor M2 to drive and thereby causes the third transport screw 85 to rotate.

The counting unit 902 separately accumulates the rotation time of the third transport screw 85 in the first supply state and the rotation time of the third transport screw 85 in the second supply state. In doing so, the counting unit 902 detects the rotation time of the third transport screw 85 by referring to the output signal from the PI sensor 91, which is in accordance with the rotation of the detection-target piece 81H of the second worm wheel 81.

The consumption amount calculation unit 903, in accordance with the rotation times accumulated by the counting unit 902, calculates the flow rate of toner flowing in the horizontal merging part 60 in each of the first supply state and the second supply state, and thereby calculates the toner consumption amount of each of the upper toner container 51 and the lower toner container 52. The toner flow rate in the horizontal merging part 60 can be calculated as the product of the cross-sectional area of the pipe shape of the horizontal merging part 60, the rotation count (the rotation speed) of the third transport screw 85, and the spiral blade pitch of the third main transport blade 851. Here, the first horizontal transport part 58 and the second horizontal transport part 59 are kept in toner-filled state, because toner is supplied as necessary from the upper toner container 51 to the first vertical transport part 56 in accordance with detection signals from the first sensor S1, and toner is supplied as necessary from the lower toner container 52 to the second vertical transport part 57 in accordance with detection signals from the second sensor S2. Accordingly, the horizontal merging part 60, which receives toner from the first horizontal transport part 58 and the second horizontal transport part 59, is also kept in toner-filled state, and thus, toner flow rate can be accurately calculated by calculating the above-described product. Further, the toner flow rate in the horizontal merging part 60 having been calculated and the cumulative rotation times counted by the counting unit 902 are multiplied, whereby the toner consumption amount of each of the upper toner container 51 and the lower toner container 52 can be calculated.

Note that the counting unit 902 resets the respective cumulative rotation times when a new upper toner container 51 and a new lower toner container 52 are mounted onto the image forming device 10. For the acquisition of information regarding the mounting of the new upper toner container 51 and the new lower toner container 52, information from an undepicted RFID memory provided to each container may be referred to besides the output from the first sensor S1 and the second sensor S2. Further, information regarding the mounting of the new upper toner container 51 and the new lower toner container 52 may be input from the undepicted operation unit of the image forming device 10 by a user or a maintenance worker. Further, when the consumption amount of each toner container approaches the amount of toner filling new toner containers, the consumption amount calculation unit 903 causes the display unit 92 to display empty information of the toner container. As a result, a user can recognize that a toner container is approaching empty state or has reached the empty state. Note that when one of the upper toner container 51 and the lower toner container 52 becomes empty, the drive control unit 901 switches the drive of the container driving unit MC, the first motor M1, and the second motor M2 between the first supply state and the second supply state so that toner is supplied to the developing device 23 from the other toner container.

The storage unit 904 has stored therein in advance information of various threshold values and calculation information such as constants to be used for calculation, which are to be referred to by the drive control unit 901 and the consumption amount calculation unit 903.

As described above, in the present embodiment, in the device main body 11, two toner containers are arranged with respect to the developing device 23. Further, toner can be selectively supplied from the two toner containers to the developing device 23, and thus the amount of time can be shortened during which the operation of the image forming device 10 stops as a result of a toner container becoming empty of toner. The upper toner container 51 and the lower toner container 52 are arranged inside the device main body 11 so that the upper toner container 51 and the lower toner container 52 are adjacent to one another in the vertical direction and the horizontal direction (in an oblique arrangement). Therefore, an increase in the horizontal direction width of the device main body 11 can be suppressed compared to a case in which two toner containers are arranged to be adjacent to one another only in the horizontal direction. Further, the drive control unit 901 of the control unit 90 controls the driving system (the container driving unit MC, the first motor M1, and the second motor M2) of the toner supplying unit 5 so that toner is supplied to the developing device 23 from one toner container among the upper toner container 51 and the lower toner container 52 and so that, when this toner container becomes empty, toner is supplied to the developing device 23 from the other toner container among the upper toner container 51 and the lower toner container 52. Hence, a configuration is made so that, even when the upper toner container 51 becomes empty, an image forming operation can be promptly executed by using the lower toner container 52. As a result, the frequency and time are reduced of stops of the image forming operation occurring due to a situation in which a toner container becomes empty of toner and the toner container is replaced.

Further, in the present embodiment, the first transport screw 74 of the first horizontal transport part 58 and the second transport screw 75 of the second horizontal transport part 59, which transport toner to the horizontal merging part 60, are selectively driven to rotate. Hence, a situation in which toner from the upper toner container 51 and toner from the lower toner container 52 are mixed inside the horizontal merging part 60 is suppressed compared to a case in which both the first transport screw 74 and the second transport screw 75 are simultaneously rotated. Thus, the toner consumption amount of the upper toner container 51 and the toner consumption amount of the lower toner container 52 can each be calculated based on the toner flow rate in the horizontal merging part 60. In particular, it is possible to calculate the consumption amounts of the two toner containers independently and accurately. Further, the container driving unit MC is controlled in accordance with detection information from the first sensor S1 and the second sensor S2 so that the first vertical transport part 56 and the second vertical transport part 57, which are respectively located at the upstream side of the first horizontal transport part 58 and the second horizontal transport part 59, are filled with toner. Thus, the toner consumption amount of the upper toner container 51 and the toner consumption amount of the lower toner container 52 can each be calculated accurately based on the toner flow rate in the horizontal merging part 60, because the horizontal merging part 60 is filled with toner.

Further, in the present embodiment, the upper toner container 51 and the lower toner container 52 are arranged at the same mounting direction position inside the device main body 11. Therefore, the size of the device main body 11 in the front-rear direction can be reduced compared to a case in which the upper toner container 51 and the lower toner container 52 are arranged to be displaced from one another in the front-rear direction. Further, the first vertical transport part 56 is arranged below the mounting direction front end part of the upper toner container 51 mounted onto the first position so that, in the horizontal direction, the first vertical transport part 56 faces the mounting direction front end part of the lower toner container 52 mounted onto the second position (FIG. 3). Therefore, a part of the toner supplying unit 5 (the first vertical transport part 56) can be efficiently arranged by utilizing a step portion formed by the two toner containers. Therefore, the vertical direction size and the horizontal direction size of the image forming device 10 can be made compact.

Further, in the present embodiment, the transmission destination of rotational driving force of the first motor M1 is switched between the first transport screw 74 and the second transport screw 75 depending upon the rotation direction of the first motor M1. Therefore, it becomes possible to selectively rotate the first transport screw 74 or the second transport screw 75 by using the rotational driving force of one first motor M1. Hence, it is possible to selectively transport toner in the first horizontal transport part 58 or the second horizontal transport part 59, and thus, the toner supply system of the image forming device 10 can be realized with a compact size and at a low cost.

Further, in the present embodiment, the position at which the first horizontal transport part 58 and the horizontal merging part 60 communicate with one another is arranged at a predetermined distance along the horizontal direction with respect to the position at which the first vertical transport part 56 and the first horizontal transport part 58 communicate with one another (a step shape is formed). Further, the position at which the second horizontal transport part 59 and the horizontal merging part 60 communicate with one another is arranged at a predetermined distance along the horizontal direction with respect to the position at which the second vertical transport part 57 and the second horizontal transport part 59 communicate with one another (a step shape is formed). Since such step shapes are provided, a situation in which toner inside the first vertical transport part 56 flows into the horizontal merging part 60 while the rotation of the first transport screw 74 is being stopped can be prevented. Similarly, a situation in which toner inside the second vertical transport part 57 flows into the horizontal merging part 60 while the rotation of the second transport screw 75 is being stopped can be prevented.

In the present embodiment, when the upper toner container 51 is mounted onto the device main body 11, a part of the toner inside the upper toner container 51 flows into the first vertical transport part 56 by free fall, as illustrated in FIG. 7. Similarly, when the lower toner container 52 is mounted onto the device main body 11, a part of the toner inside the lower toner container 52 flows into the second vertical transport part 57 by free fall. Further, the vertical direction length of the first vertical transport part 56 is set longer than the vertical direction length of the second vertical transport part 57. According to such a configuration, the amount of toner flowing into the first vertical transport part 56 when a new upper toner container 51 is mounted onto the first position tends to be greater than the amount of toner flowing into the second vertical transport part 57 when a new lower toner container 52 is mounted onto the second position. In such a case, it becomes difficult to accurately calculate the consumption amounts of the toner containers if toner rapidly flows into the horizontal merging part 60 from the first vertical transport part 56 and the second vertical transport part 57 through the first horizontal transport part 58 and the second horizontal transport part 59, respectively. Even in such a case, a situation in which toner inside the first vertical transport part 56 flows into the horizontal merging part 60 while the rotation of the first transport screw 74 is being stopped can be prevented, because the toner supply system of the image forming device 10 is provided with the structure as illustrated in FIG. 5 according to this configuration. Similarly, a situation in which toner inside the second vertical transport part 57 flows into the horizontal merging part 60 while the rotation of the second transport screw 75 is being stopped can be prevented. Therefore, it is possible to accurately calculate the consumption amount of each toner container.

Further, in the present embodiment, the image forming part 13 includes a plurality of image forming units 13BK, 13M, 13C, 13Y arranged in correspondence with toners of a plurality of colors, and the upper toner containers 51 of the plurality of image forming units are arranged adjacent to one another in the horizontal direction and the lower toner containers 52 of the plurality of image forming units are arranged adjacent to one another in the horizontal direction. Further, when viewed along the axial direction of the photoreceptor drums 20, the upper toner containers 51 and the lower toner containers 52 of the plurality of image forming units are arranged in a staggered pattern. Therefore, even when a configuration is adopted in which an image is formed on a sheet P by using toner of a plurality of colors, the frequency of occurrence of a situation in which the image forming operation stops due to the replacement of toner containers of the respective colors can be reduced and an increase in size of the device main body 11 in the horizontal direction can be suppressed. Further, as illustrated in FIG. 2, the intermediate transfer unit 14 is arranged by utilizing the height across which toner is supplied from the upper toner containers 51 and the lower toner containers 52 to the developing devices 23 of the respective colors. In other words, the toner supplying units 5 of the respective colors are arranged by using positions above and behind the intermediate transfer unit 14.

Further, in the present embodiment, the upper toner container 51 and the lower toner container 52 are mounted onto the device main body 11 along the predetermined horizontal mounting direction DM (the rear direction), and the first direction and the second direction are inclined by a predetermined angle with respect to the mounting direction (FIG. 4). Therefore, the space occupied by the first horizontal transport part 58 and the second horizontal transport part 59 can be made compact.

The image forming device 10 according to one embodiment of the present disclosure has been described in detail above. According to such a configuration, it is possible to provide an image forming device that includes a toner supply system in which toner discharged from a plurality of toner containers is supplied to a developing device after merging and that is capable of accurately calculating the toner consumption amount of each toner container. Note that the present disclosure is not limited to this. For example, the present disclosure can adopt modified embodiments as described in the following.

(1) In the above embodiment, description has been provided based on a form in which a toner supplying unit 5 and a developing device 23 are arranged for toner of each of the four colors. However, the present disclosure may also be applied to an image forming device (a monochromatic device or the like) that includes a structure as illustrated in FIG. 3.

(2) In the above-described embodiment, description is provided based on a form in which the upper toner container 51 and the lower toner container 52 transport toner inside by the main body portions of the containers rotating. However, the toner containers may be those in which rotatable toner transport members, such as screws, are provided inside the toner containers.

(3) Further, the toner supply request from the developing device 23 that the drive control unit 901 refers to for executing toner discharge from the upper toner container 51 and the lower toner container 52 is not limited to the output from the toner sensor 93. A form may be adopted in which the judgment of toner supply with respect to the developing device 23 is made based on other types of information, such as image information in the image forming device 10, density information of patch images on the intermediate transfer belt 141 of the intermediate transfer unit 14, etc.

(4) In the structure of the image forming device 10 illustrated in FIG. 2, an individual openable/closable cover may be provided in front of each of the eight toner containers (the upper toner containers 51 and the lower toner containers 52). The toner containers can be replaced by opening these covers. Further, it is desirable that the opening/closing of each cover is locked/unlocked by an undepicted lock mechanism. In such a case, the control unit 90 releases the lock mechanism of the cover facing a toner container that has become empty, whereby erroneous replacement of toner containers in which toner is present can be prevented.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming device comprising:

a device main body;

a photoreceptor drum that is rotated about a predetermined axis and has a circumferential surface that allows an electrostatic latent image to be formed and carries a toner image that is in accordance with the electrostatic latent image;

a developing device that supplies toner to the photoreceptor drum to visualize the electrostatic latent image into the toner image;

a first toner container that stores toner inside and is capable of discharging the toner;

a second toner container that stores toner inside and is capable of discharging the toner;

a first vertical transport part that guides toner discharged from the first toner container downward along a vertical direction;

a second vertical transport part that guides toner discharged from the second toner container downward along the vertical direction;

a first horizontal transport part that communicates with a lower end part of the first vertical transport part and guides toner having flowed in from the first vertical transport part in a first direction along a horizontal direction;

a second horizontal transport part that communicates with a lower end part of the second vertical transport part and guides toner having flowed in from the second vertical transport part in a second direction along the horizontal direction;

a first transport member that is rotatably arranged in the first horizontal transport part and transports toner in the first direction;

a second transport member that is rotatably arranged in the second horizontal transport part and transports toner in the second direction;

a third horizontal transport part that communicates with each of a first direction downstream portion of the first horizontal transport part and a second direction downstream portion of the second horizontal transport part, and receives toner having been transported by the first transport member and toner having been transported by the second transport member at an inside of the third horizontal transport part and guides the toner in a third direction along the horizontal direction;

a third transport member that is rotatably arranged in the third horizontal transport part and transports toner in the third direction;

a third vertical transport part that communicates with a third direction downstream portion of the third horizontal transport part and guides toner having been transported by the third transport member to the developing device along the vertical direction;

a first transport driving unit that generates driving force for selectively rotating the first transport member or the second transport member;

a second transport driving unit that generates driving force for rotating the third transport member;

a container driving unit that generates driving force for selectively discharging toner from the first toner container or the second toner container;

a first detection sensor arranged at the first vertical transport part and detects whether or not toner is present in the first vertical transport part;

a second detection sensor arranged at the second vertical transport part and detects whether or not toner is present in the second vertical transport part;

a drive control unit that controls the first transport driving unit, the second transport driving unit, and the container driving unit, wherein, the drive control unit is capable of switching between a first supply state and a second supply state, the first supply state being a state in which, in accordance with a toner supply request from the developing device, toner is supplied to the developing device from the first toner container, the first vertical transport part, the first horizontal transport part, the third horizontal transport part, and the third vertical transport part, the second supply state being a state in which, in accordance with the toner supply request from the developing device, toner is supplied to the developing device from the second toner container, the second vertical transport part, the second horizontal transport part, the third horizontal transport part, and the third vertical transport part, and in the first supply state, the drive control unit, in accordance with information that is detected by the first detection sensor and indicates a toner-less state in the first vertical transport part, controls the container driving unit and causes toner to be discharged from the first toner container to the first vertical transport part, and in accordance with the toner supply request, controls the first transport driving unit and the second transport driving unit to cause the first transport member and the third transport member to rotate in a state in which rotation of the second transport member is stopped, and in the second supply state, the drive control unit, in accordance with information that is detected by the second detection sensor and indicates a toner-less state in the second vertical transport part, controls the container driving unit and causes toner to be discharged from the second toner container to the second vertical transport part, and in accordance with the toner supply request, controls the first transport driving unit and the second transport driving unit to cause the second transport member and the third transport member to rotate in a state in which rotation of the first transport member is stopped;

a counting unit that accumulates a rotation time of the third transport member; and a consumption amount calculation unit that calculates a flow rate of toner flowing in the third horizontal transport part in each of the first supply state and the second supply state and thereby calculates a toner consumption amount of each of the first toner container and the second toner container in accordance with the rotation time accumulated by the counting unit.

2. The image forming device according to claim 1, wherein the first transport driving unit includes:

a first motor capable of rotating in a first rotation direction and a second rotation direction opposite the first rotation direction;

a first transmission member that is interposed between the first motor and the first transport member, the first transmission member allowing the first transport member to rotate when the first motor is rotated in the first rotation direction and inhibiting the first transport member from rotating when the first motor is rotated in the second rotation direction; and a second transmission member that is interposed between the first motor and the second transport member, the second transmission member allowing the second transport member to rotate when the first motor is rotated in the second rotation direction and inhibiting the second transport member from rotating when the first motor is rotated in the first rotation direction.

3. The image forming device according to claim 2, wherein the first transmission member is a first one-way gear fixed to one end of the first transport member, the second transmission member is a second one-way gear fixed to one end of the second transport member, the first transport driving unit includes a first intermediate gear that is arranged coaxially with the third transport member at one end side of the third transport member and receives one end of the third transport member at an inside of the first intermediate gear and that is rotatable relative to the third transport member, wherein the first intermediate gear transmits rotational driving force of the first motor to the first one-way gear and the second one-way gear, and the second transport driving unit includes:

a second motor; and a second intermediate gear that is fixed to the one end of the third transport member penetrating through the first intermediate gear, that is interposed between the second motor and the third transport member, and transmits rotational driving force of the second motor to the third transport member.

4. The image forming device according to claim 1, wherein a position at which the first horizontal transport part and the third horizontal transport part communicate with one another is arranged at a predetermined distance along the horizontal direction with respect to a position at which the first vertical transport part and the first horizontal transport part communicate with one another, and a position at which the second horizontal transport part and the third horizontal transport part communicate with one another is arranged at a predetermined distance along the horizontal direction with respect to a position at which the second vertical transport part and the second horizontal transport part communicate with one another.

5. The image forming device according to claim 4, wherein the first toner container is configured to be attachable and detachable to and from a first position inside the device main body and so that at least a part of the toner in the first toner container is capable of flowing into the first vertical transport part by free fall when the first toner container is mounted onto the first position, the second toner container is configured to be attachable and detachable to and from a second position inside the device main body that is below the first position and so that at least a part of the toner in the second toner container is capable of flowing into the second vertical transport part by free fall when the second toner container is mounted onto the second position, and a vertical direction length of the first vertical transport part is set longer than a vertical direction length of the second vertical transport part.

6. The image forming device according to claim 5, wherein the first toner container and the second toner container have a cylindrical shape extending along a predetermined longitudinal direction and are respectively mounted onto the first position and the second position along a mounting direction that is parallel to the longitudinal direction, and the first vertical transport part is arranged below a mounting direction front end part of the first toner container mounted onto the first position so that, in the horizontal direction, the first vertical transport part faces a mounting direction front end part of the second toner container mounted onto the second position.

7. The image forming device according to claim 1, wherein the first toner container and the second toner container are mounted onto the device main body along a predetermined horizontal mounting direction, and the first direction and the second direction are each inclined by a predetermined angle with respect to the mounting direction.

* * * * *